US007021491B2

(12) United States Patent
Sloss et al.

(10) Patent No.: US 7,021,491 B2
(45) Date of Patent: Apr. 4, 2006

(54) FREEZER DOOR OPENER/CLOSER FOR A VENDING MACHINE

(75) Inventors: Andris C. Sloss, Hackettstown, NJ (US); David K. Giegerich, River Vale, NJ (US); Munroe Chirnomas, Morris Township, NJ (US)

(73) Assignee: Fastcorp, LLC, Shawnee Mission, KS (US)

( * ) Notice: Subject to any disclaimer, the term of this patent is extended or adjusted under 35 U.S.C. 154(b) by 211 days.

(21) Appl. No.: 10/402,174

(22) Filed: Mar. 27, 2003

(65) Prior Publication Data

US 2004/0050852 A1 Mar. 18, 2004

Related U.S. Application Data

(60) Provisional application No. 60/368,081, filed on Mar. 27, 2002.

(51) Int. Cl.
*A24F 27/14* (2006.01)

(52) U.S. Cl. ..... 221/150 R; 221/243; 221/312 R; 49/356; 49/362; 312/293.2

(58) Field of Classification Search ..... 221/150 R, 221/312 R, 243; 49/324, 325, 328, 329, 49/356, 362; 62/336, 458; 271/145; 312/293.2
See application file for complete search history.

(56) References Cited

U.S. PATENT DOCUMENTS

| | | | | |
|---|---|---|---|---|
| 2,720,338 | A * | 10/1955 | Kovac | 221/243 |
| 4,209,110 | A * | 6/1980 | Ono | 221/73 |
| 5,240,139 | A * | 8/1993 | Chirnomas | 221/2 |
| 6,253,955 | B1 * | 7/2001 | Bower | 221/150 R |
| 6,481,226 | B1 * | 11/2002 | Jones et al. | 62/190 |
| 2003/0222094 | A1 * | 12/2003 | Chirnomas | 221/123 |

* cited by examiner

*Primary Examiner*—David H. Bollinger
(74) *Attorney, Agent, or Firm*—Sonnenschein Nath & Rosenthal LLP; Bryan P. Stanley

(57) ABSTRACT

An article handler having an article storage area and an article dispensing opening at a top portion thereof, with a hinged lid mounted so as to have at least a predetermined range of arcuate movement thereover. The lid has a lifting portion thereon adapted for engagement with a lid opening/closing mechanism, and a lid opening/closing mechanism mounted adjacent the cooled article storage area. The mechanism has an engaging portion adapted for positively engaging the lid lifting portion, and a drive portion for positively and alternately driving the engaging portion in a direction toward the lid lifting portion and then in a reverse direction, wherein the engaging portion is adapted to positively engage the lid lifting portion while being driven toward the lid lifting portion and at a time after initial contact with the lid lifting portion, and the engaging portion is adapted to then positively disengage the lid lifting portion while being driven in the reverse direction, after a substantial portion of the entire predetermined range of arcuate movement of the lid has been completed.

8 Claims, 11 Drawing Sheets

FREEZER DOOR OPENER/CLOSER FOR A VENDING MACHINE

CROSS-REFERENCE TO RELATED APPLICATIONS

This application claims priority under 35USC 120 of U.S. Provisional Patent Application No. 60,368,081 filed Mar. 27, 2002, entitled "Freezer Door Opener/Closer For A Vending Machine". The entire disclosure of this patent application is incorporated herein by reference in its entirety.

BACKGROUND OF THE INVENTION

The environment of the present invention is generally a lid lifter, and more specifically a lifter for a lid of a storage area of an article handler. In one embodiment the environment may be a refrigerated vending machine of the type, for example, as described in issued U.S. Pat. No. 5,240,139 entitled Package Vending Machine, issued on Aug. 31, 1993 to Munroe Chimomas. This type of vending machine includes a cabinet having the conventional equipment associated therewith needed for accomplishing vending, such as a user article selection and payment system, an article storage area and an article dispensing mechanism. In the forenoted U.S. patent, the article storage area advantageously comprises a conventional chest freezer mounted in the vending machine cabinet to form the refrigerated, and in fact frozen, storage area. In order to efficiently maintain the articles in the refrigerated condition, the chest freezer has a thermal barrier, i.e., a lid over the top-opening used by the article dispensing mechanism to retrieve and dispense the articles stored therein. Various types of thermal barriers are possible, one such barrier comprising a one-piece door hinged for arcuate opening/closing movement over the top-opening of the freezer.

It is desired that the opening/closing movement of the lid be accomplished by a mechanism which will:

Reliably and securely raise the lid to its fully open position, and not beyond that position, Reliably and securely hold the lid at its fully open position, Reliably and securely pull the lid towards the closed position after it has been put into a fully open position, Reliably and securely position the lid to the fully closed position upon completion of a dispensing operation.

Reliably and fully disengage from the lid when not in use so as to not interfere with manual operation of the lid, which manual operation may be desired during reloading or servicing of the machine, or in the event of a power failure.

SUMMARY OF THE INVENTION

The present invention provides a novel freezer door opener/closer for use, for example, in a vending machine.

Features of the novel lid opening/closing mechanism are:

Positive engagement of the lid opening/closing mechanism with the lid during opening and closing, thereby allowing powered control of the movement of the lid during its opening and closing, Continued engagement of the lid opening/closing mechanism with the lid from a time just after the lid is starting to open to a time just before it is fully closed, thereby allowing the powered control of the movement of the lid during substantially all of its opening and closing movement, and Complete disengagement of the lid opening/closing mechanism when the lid is fully closed, thereby allowing manual operation of the lid during re-loading or servicing of the machine, or in the event of a power failure.

The above features and advantages are achieved by providing in a vending machine:

A cooled article storage area, having an article dispensing opening at a top portion thereof, and a hinged lid mounted so as to have at least a predetermined range of arcuate movement thereover, The lid having a lifting portion thereon adapted for engagement with a lid opening/closing mechanism, and A lid opening/closing mechanism mounted adjacent the cooled article storage area, the mechanism having

- a engaging portion adapted for positively engaging the lid lifting portion, and
- a drive portion for positively and alternately driving the engaging portion in a direction toward the lid lifting portion and then in a reverse direction,
- wherein the engaging portion is adapted to positively engage the lid lifting portion while being driven by the drove portion toward the lid lifting portion and at a time after initial contact with the lid lifting portion, and the engaging portion is adapted to then positively disengage the lid lifting portion while being driven in the reverse direction, after a substantial portion of the entire predetermined range of arcuate movement of the lid has been completed.

In a preferred embodiment, the lid lifting portion comprises a pin extending from a side of the lid, and the engaging portion comprises a claw adapted to rotatably engage the pin.

More specifically, in one embodiment the pin may have a round cross-section, and the claw can comprise a spring-loaded pivoting arm having a hook at one end which engages the pin upon pressured contact with the pin, and disengages the pin upon the other end of the pivoting arm engaging a protrusion. The protrusion can be a part of the drive portion which is positioned so as to be associated with the lid nearing a closed position, i.e., near the end of the predetermined range of travel.

Alternatively, the same general function can be accomplished by a pin having a "segment of round", such as a half-round, cross-section and which positioned on the lid so as to present to the approaching claw a cross-section which is less than the diameter of the pin. The claw can simply comprise a fork having opposed sidewalls spaced apart from one another by a distance which is at least equal to the diameter of the pin. One of the sidewalls of the claw includes a tab portion which reduces the spacing between the sidewalls at an entrance into the fork to a distance which is less than the diameter of the pin but greater than the spacing of a segment of the diameter of the pin (i.e., one-half the pin diameter). With this arrangement, the diameter of the pin presented between the sidewalls of the fork is initially at a minimum (thereby allowing the pin to enter the fork, but once inside the fork and as the lid is opening, the diameter presented between the sidewalls increases due to rotation of the pin segment, thereby presenting a pin diameter between the sidewalls which is greater than the spacing between the sidewalls at the entrance to the fork, and resulting in a positive engagement between the segment of the pin and the tab-portion of the sidewall.

In an even more preferred embodiment of this aspect of the invention, the tab portion has a surface shape which engages a similarly shaped surface of the segment of round portion of the pin.

Even furthermore, the segment of pin diameter can be determined so that the increase in pin diameter presented between the forks will reach a maximum, such as the full pin diameter, at a point in the angular range of lid movement which corresponds to a fully opened position. Still further, in order to more fully and positively lock the pin at this position into the fork, the distance between the tab portion and a bottom portion of the fork is made to be equal to the segment of round spacing, i.e. one-half the pin diameter. This will cause the entire perimeter of the pin segment to be firmly engaged by the sidewalls and tab-portion of the fork, thereby preventing any slippage, or "clunk" when stopping or starting lid movement from the fully opened position.

BRIEF DESCRIPTIONS OF THE DRAWINGS

The accompanying drawings, which are incorporated herein and constitute part of this specification, illustrate embodiments and details of the invention, and, together with the general description given above and the detailed description given below, serve to explain the features of the invention.

Figure 3:
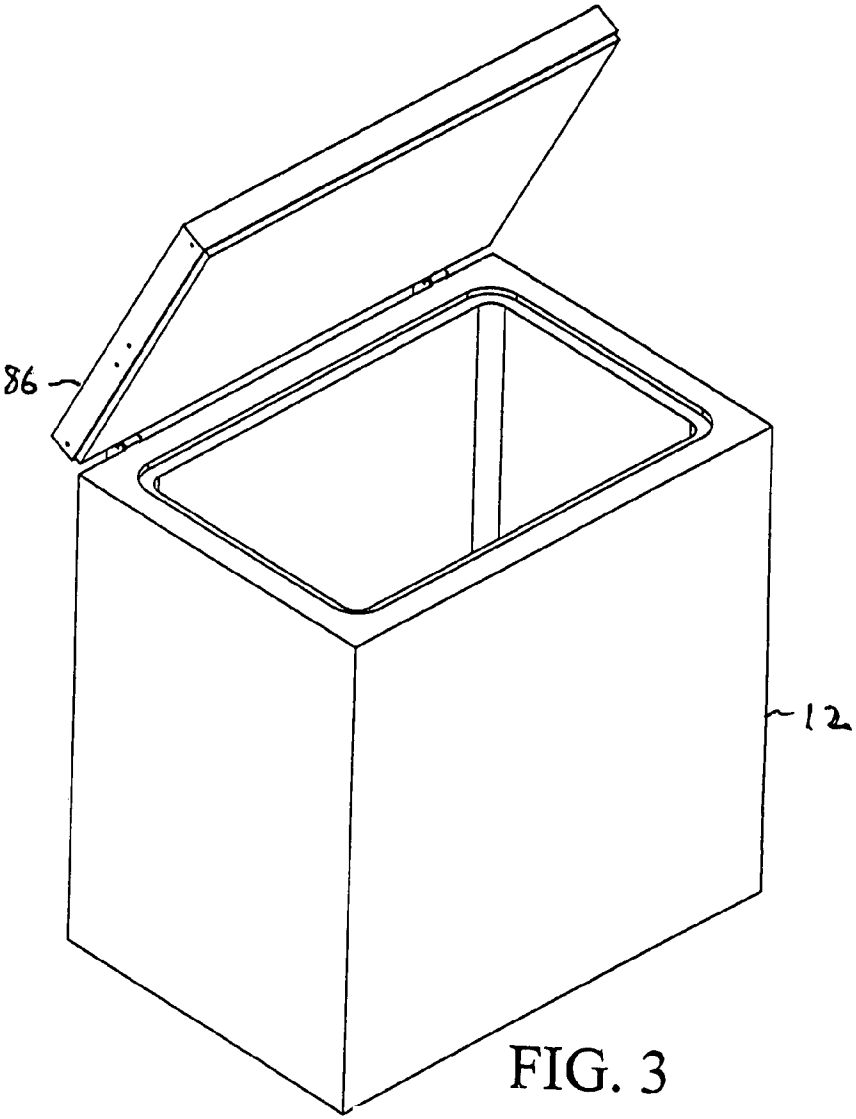
FIGS. 2 and 3 illustrate side and perspective views, respectively of a freezer having a hinged lid which operates over an angular range of motion theta (θ) between it's opened and closed positions.
Figure 2:
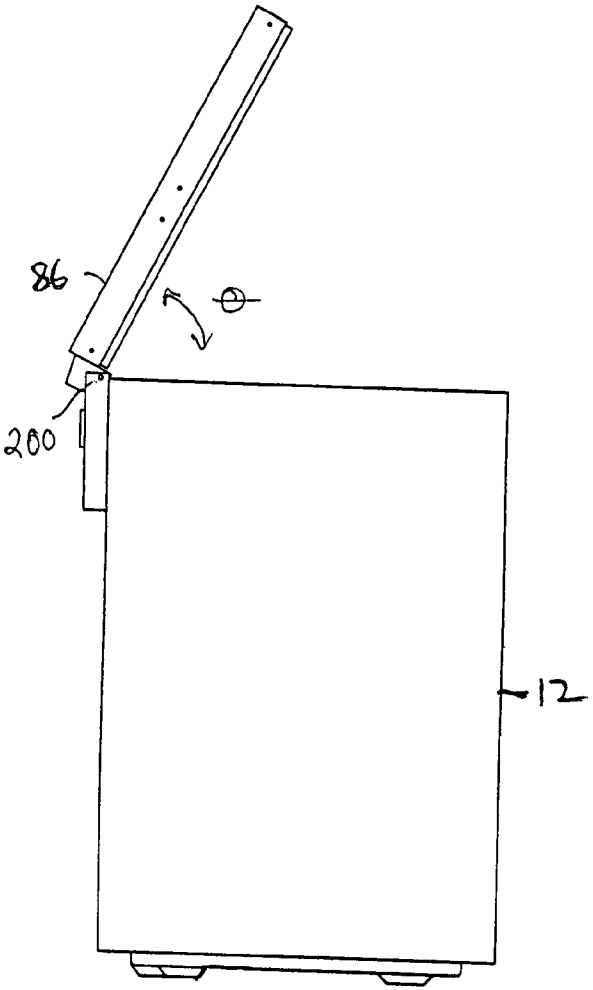
Figure 4A:
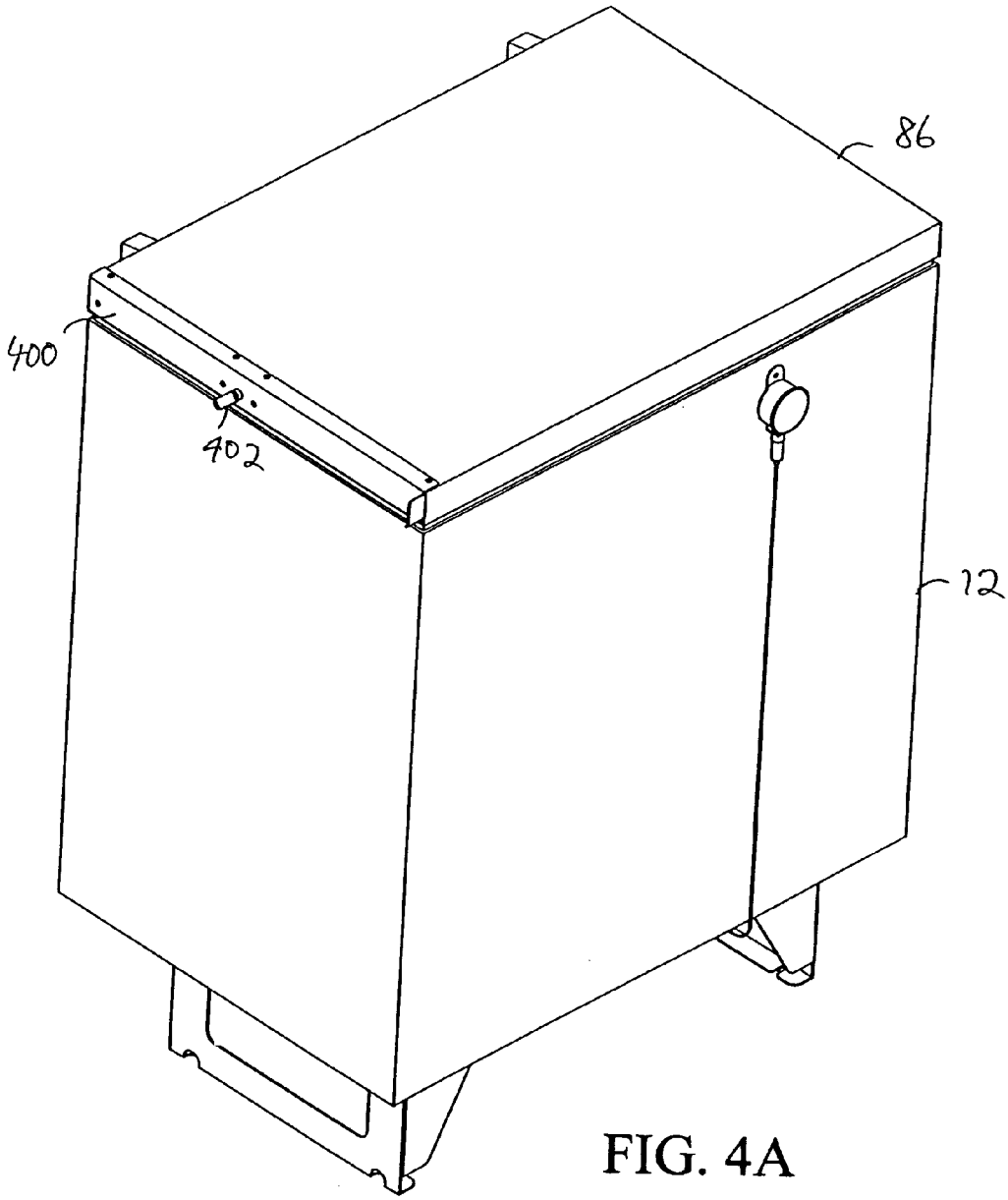

FIG. 4*a* illustrates one embodiment for the freezer of FIGS. 2 and 3, wherein a bracket is positioned along one side of the lid for supporting a lid mounted engageable portion of a lid opening mechanism which is constructed and operates in accordance with one embodiment of the present invention.

Figure 4B:
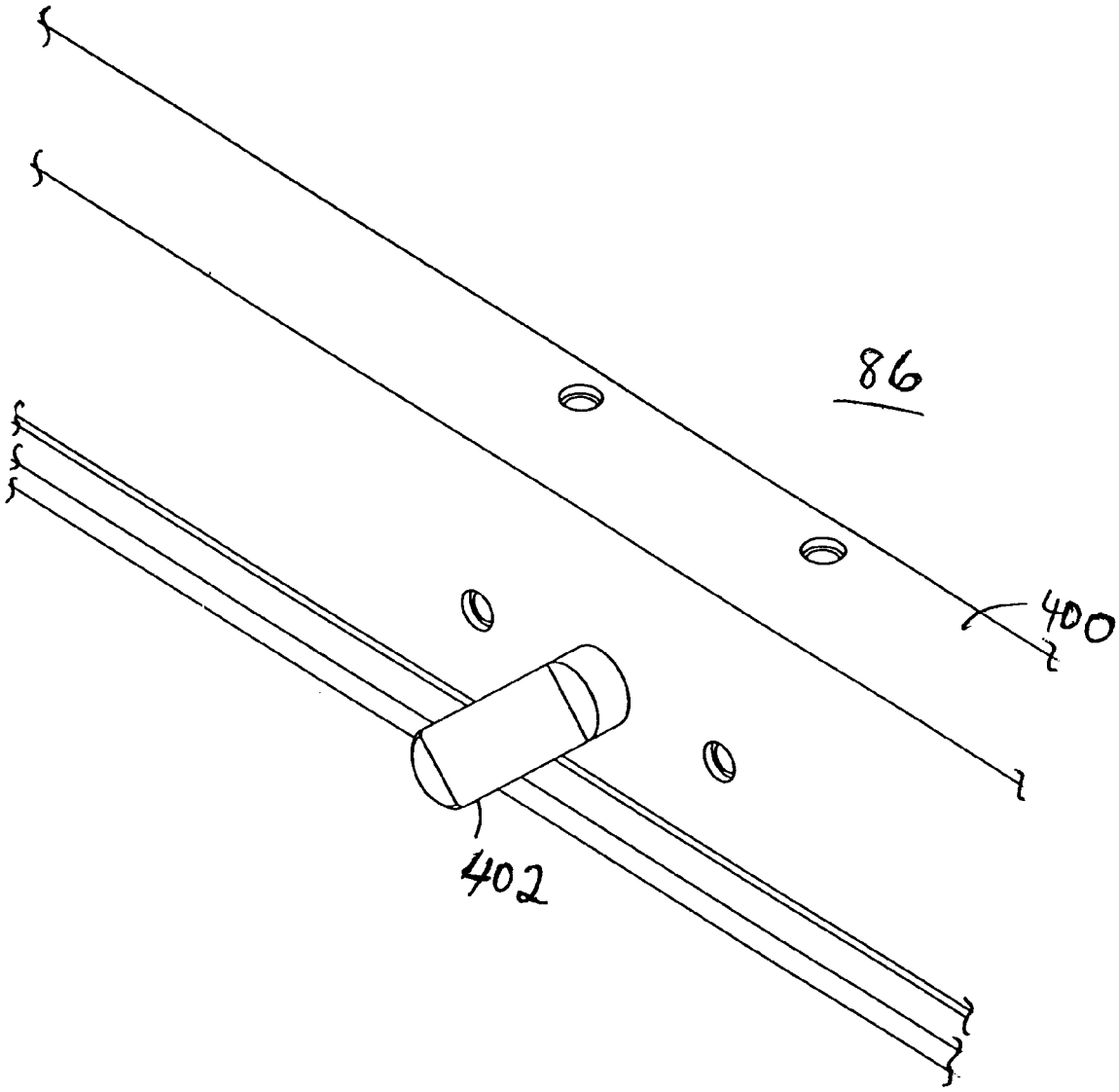

FIG. 4*b* illustrates an enlarged perspective view of the lid mounted engageable portion of FIG. 4*a*.

Figure 6:
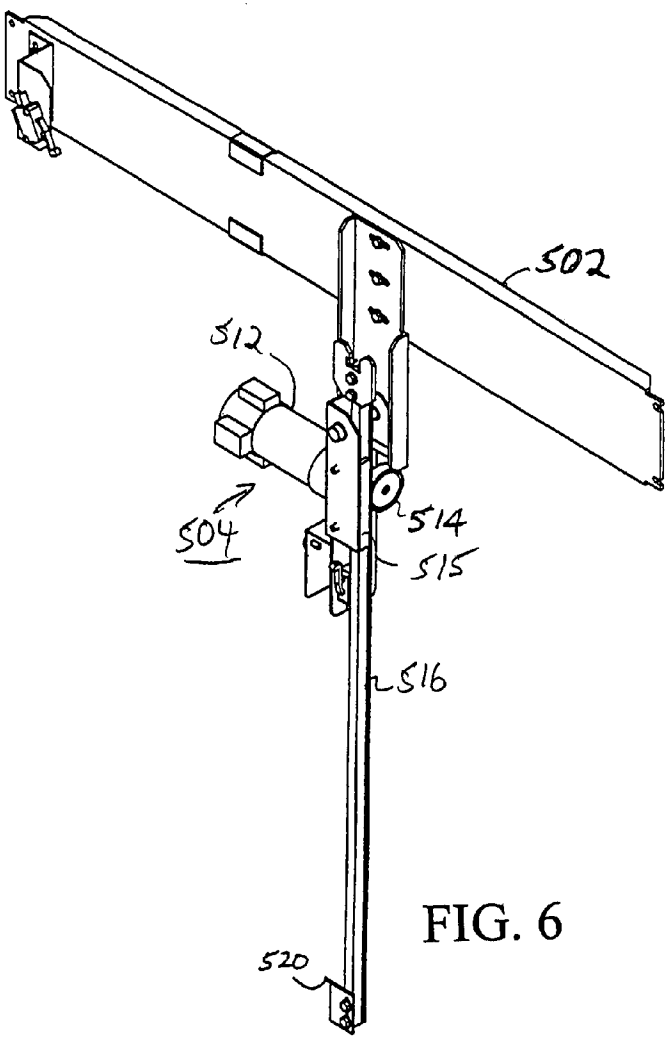
Figure 5:
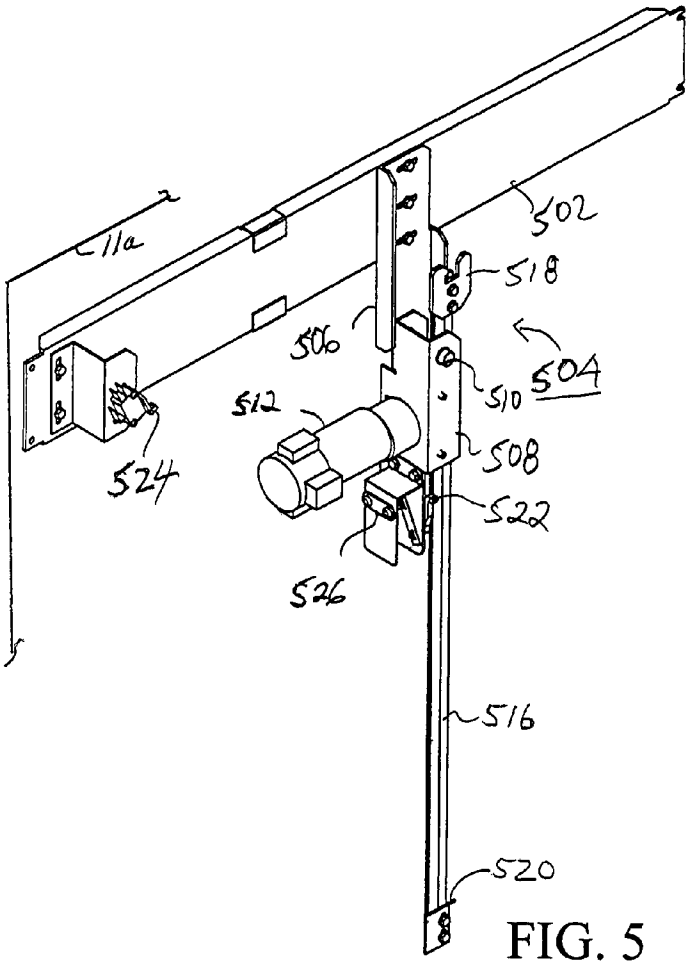
Figure 7:
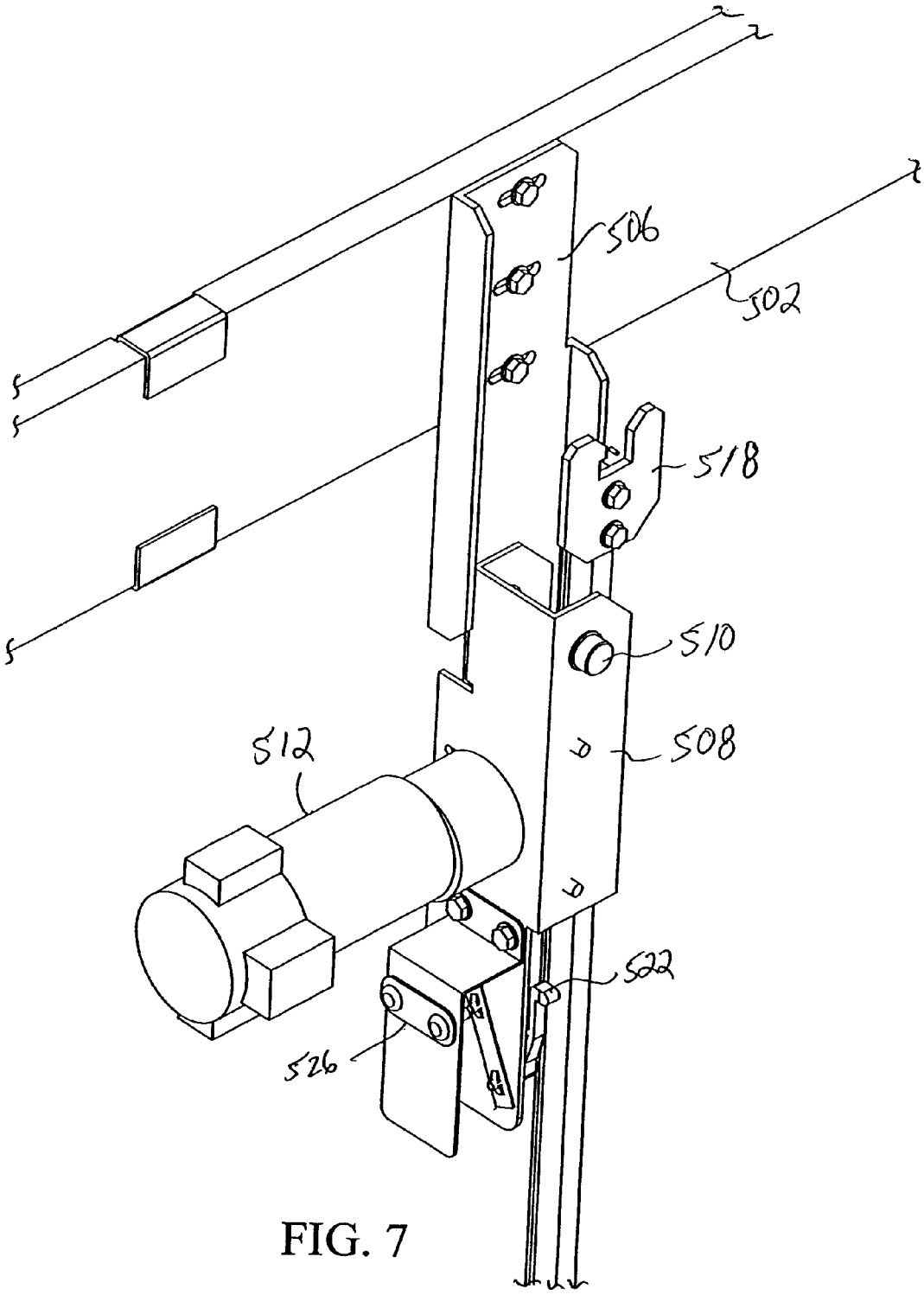
Figure 8:
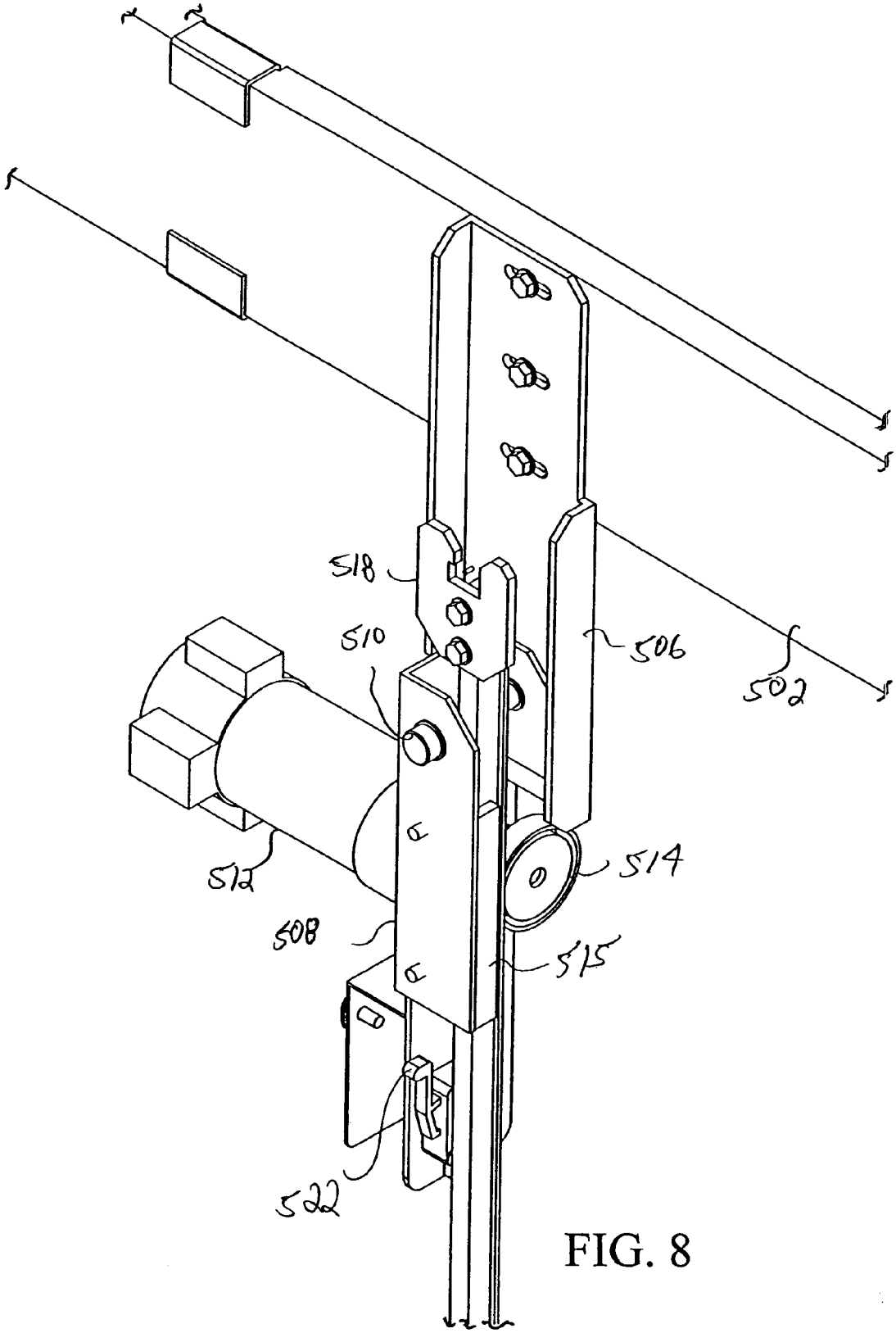

FIGS. 5 and 6 illustrate perspective left and right side views, respectively of one embodiment for a driving portion of the lid opening mechanism which is constructed and operates in accordance with one embodiment of the present invention FIGS. 7 and 8 illustrate enlarged views of a portion of FIGS. 5 and 6, respectively.

Figure 9:
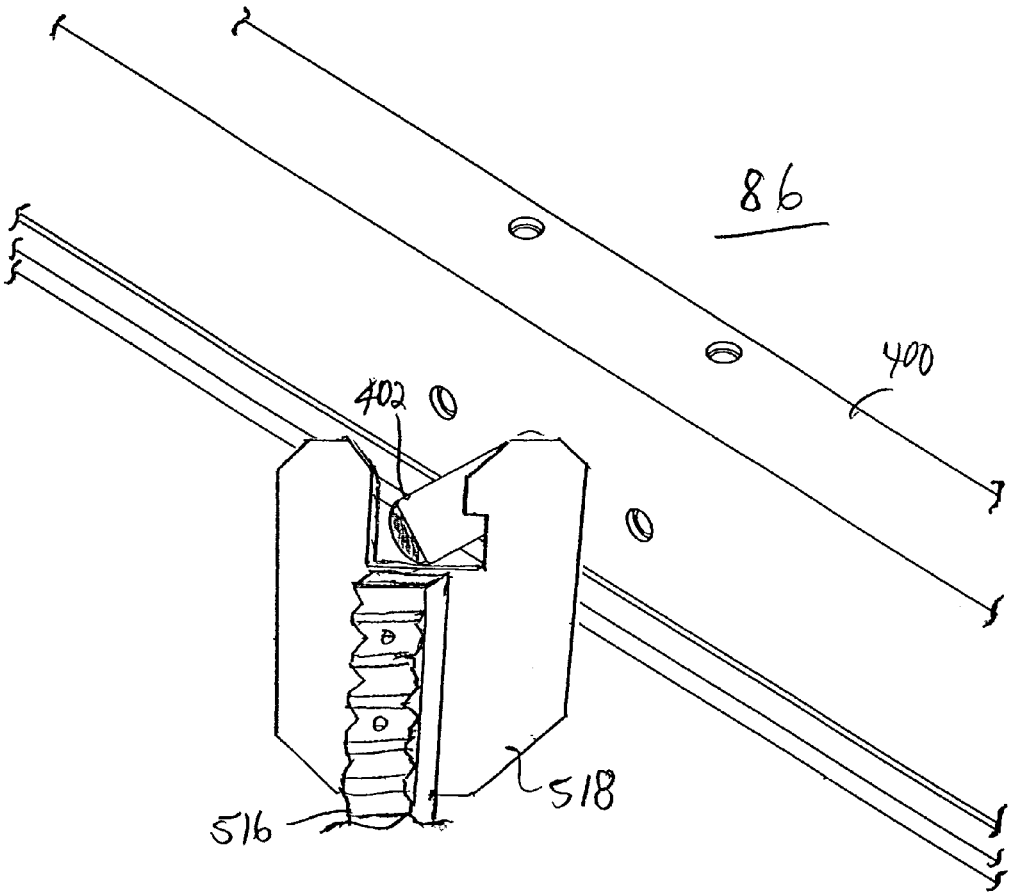

FIG. 9 illustrates initial engagement of portions of the lid opening mechanism in accordance with one aspect of the present invention.

FIGS. 10*a* through 10*d* illustrate operation of the lid opening/closing mechanism constructed and operating in accordance with one embodiment of the present invention, throughout various portions of the range of motion of the 86.

Figure 11:
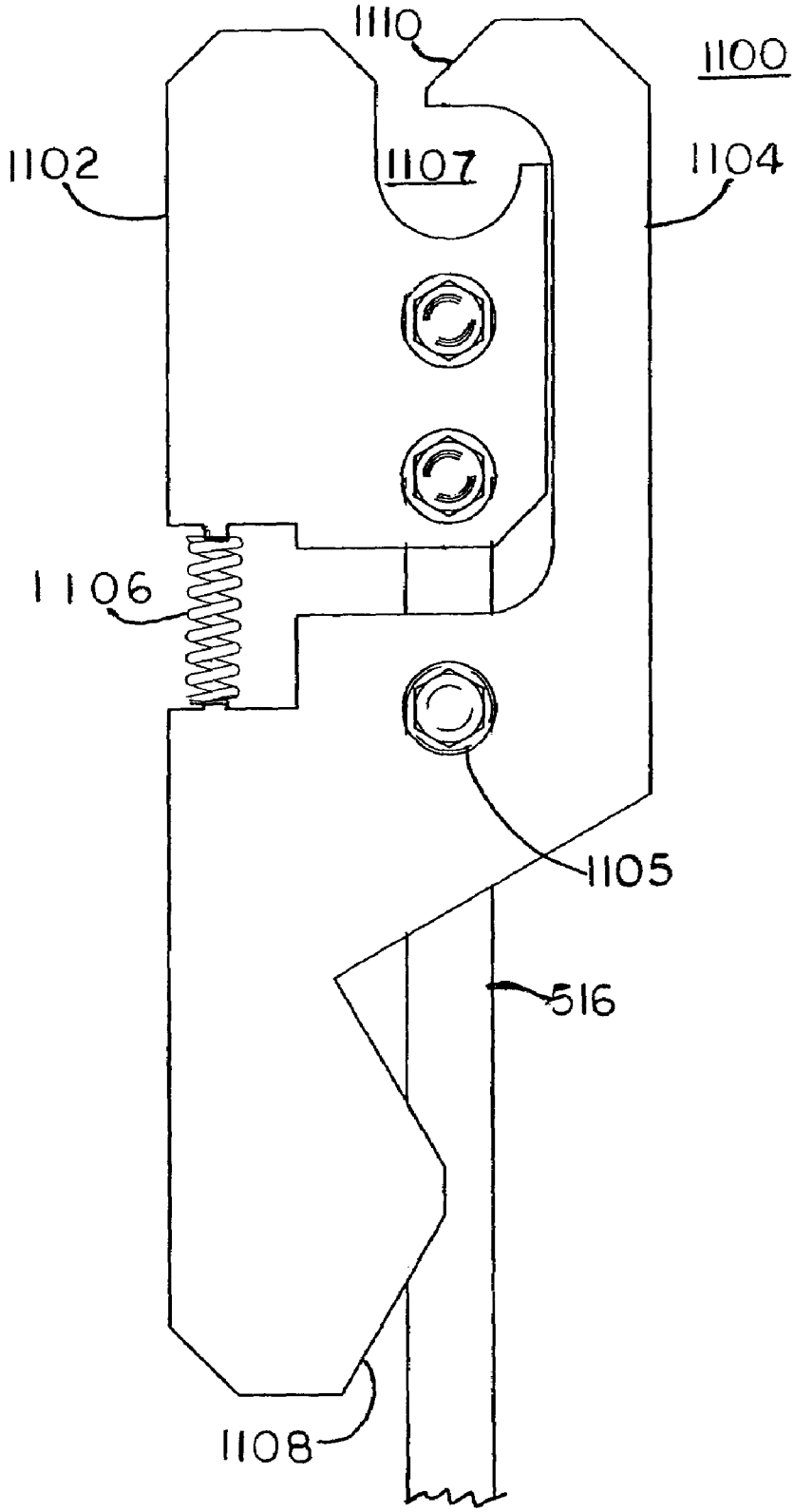
Figure 12:
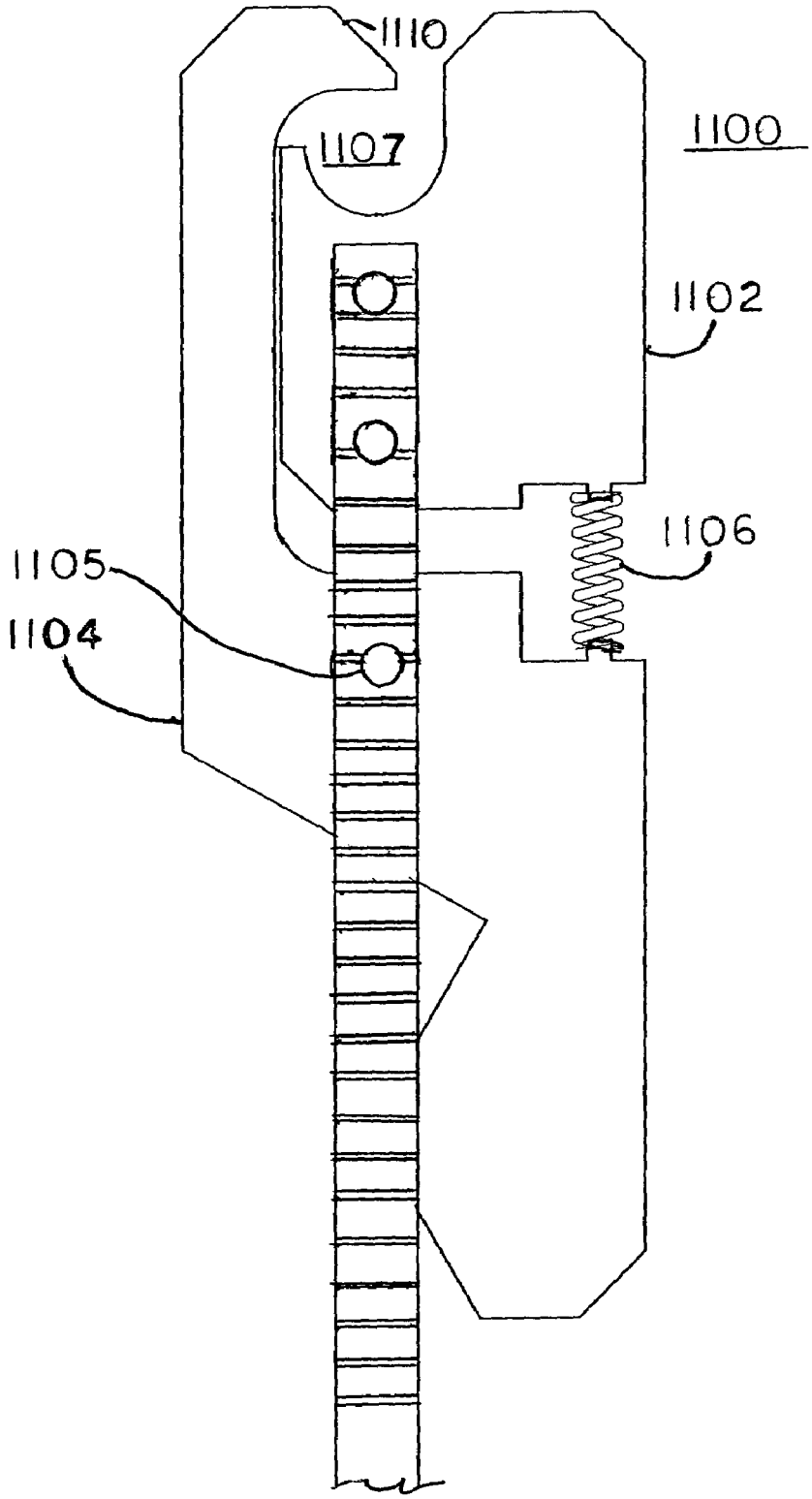

FIGS. 11 and 12 illustrate front and back views, respectively of an alternative embodiment of the engaging portion of a lifting mechanism which is constructed and operates in accordance with the principles of the present invention.

DETAILED DESCRIPTION OF THE PREFERRED EMBODIMENT

Figure 1:
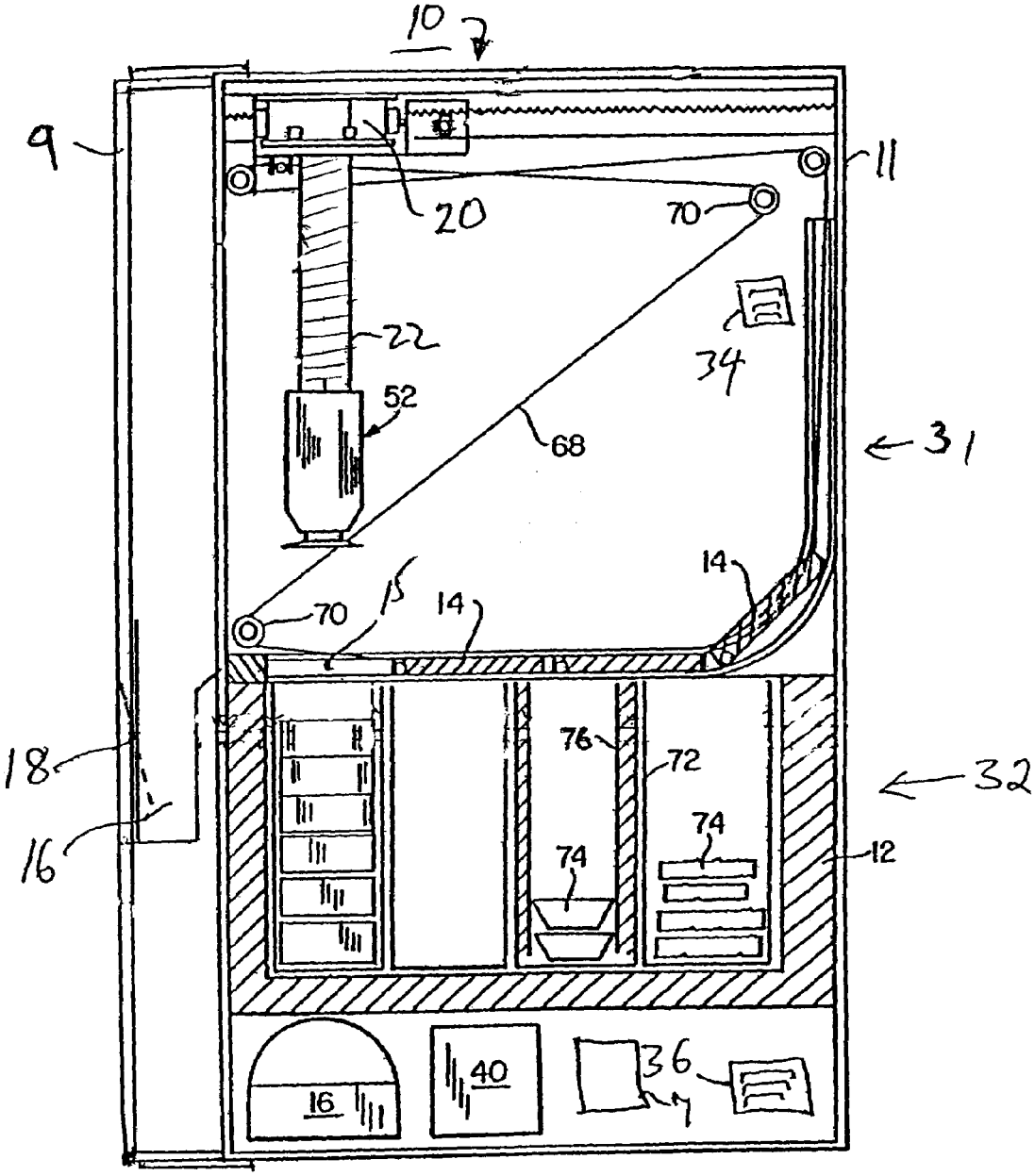
FIG. 1 is a side section view of a vending machine useful for illustrating the environment of the present invention.

FIG. 1 illustrates a prior art vending machine 10, such as known by my prior U.S. Pat. No. 5,240,139, having an outer housing 11 and hinged front door 9. Housing 11 includes therein a refrigeration unit 16 and an insulated refrigerated compartment 12 having a displaceable thermal separating door 14 positioned over an opening 15 at one end thereof. Freezer door 14 provides a thermal separation at the opening between the remainder of the interior of the vending machine and the open-top ends of subdivided sections 72 which are positioned within the refrigerated storage compartment 12. Sections 72 store articles 74, such as ice cream or other frozen or refrigerated foods in a cooled environment until they are selected by a user of vending machine 10.

In operation, after a user of the vending machine has inserted the proper payment and made a valid selection of an item stored in the vending machine, a control mechanism 40 of machine 10 causes a carriage 20 having a suction hose 22 and pickup head 52 hanging therefrom, to be laterally positioned over the section 72 which stores the selected articles. In the illustrated embodiment, movement of carriage 20 causes door 14 to become displaced, via cable 68 and rollers 70, so as to provide entry and egress of article pickup head 52. The control mechanism 40 then causes a motor in carriage 20 to operate so that the article pickup head 52 controllably enters the selected storage compartment 72, suction generated by a blower motor 7 is conducted thereto via hose 22, and the selected article 74 thereby becomes secured to the article pickup head 52. The motor in carriage 20 is operated again, this time in a reverse direction, so as to extract article pickup head 52, and the selected article, from compartment 72, and deposit the selected article in a customer retrieval area 16. A customer access door 18 allows the user access to retrieve the dispensed article.

It is also noted that in one embodiment present invention, freezer 12 may be of the type which has the evaporator coils distributed along and in thermal contact with the inside walls which form the main interior volume of freezer 12, and the condenser coils are thermally insulated from the evaporator coils and distributed along and in thermal contact with the walls which form the outside perimeter of freezer 12. With this type of freezer, no fans are required for the refrigeration system since the cooling effect of the evaporator coils is directly radiated to the interior of freezer 12, and the heat generated by the refrigeration system is directly radiated by the outside walls of freezer 12 to the external environment. Such freezers are commonly available with a single hinged lid, and can be purchased from, for example, W. C Woods Company, Inc. of Ottawa, Canada.

In view of the public availability of my above-noted patent (a copy of which is attached hereto as Attachment A), and the widely known construction and operation of vending machines of this type, no further description of how to make and use a vending machine of the type described so far, is deemed necessary.

With such a device, a reliable mechanism is desired for opening and closing the thermal separating door 14 in order to maintain the integrity of the stored articles.

The present invention is directed to a vending machine embodiment where door 14 comprises a hinged lid, such as lid 86 shown in FIG. 13 of the forenoted U.S. Pat. No. 5, 240,139

FIGS. 2 and 3 illustrate side and perspective views, respectively of a freezer 12 having a lid 86 coupled to the top of freezer 12 via a hinge mechanism 200 of conventional design. Hinge mechanism 200 may include therein springs which substantially counterbalance the weight of lid 86, so it is easily opened. Lid 86 operates over an angular range of motion theta (θ) between it's opened and closed positions. Note, the shown limits of the range of motion are purely illustrative, and different ranges are possible, such as one where lid 86 is opened approximately 90 degrees, to a vertically opened position.

FIG. 4*a*, and enlargement detail FIG. 4*b*, illustrate one embodiment for freezer 12 wherein a bracket 400 is positioned along one side of lid 86 for supporting thereon a door lifting engageable portion, i.e., a pin 402. As will be described later on, pin 402 is engaged by a lid opening/closing mechanism for effecting movement of lid 86 over its full range of motion during the dispensing operation of vending machine 10.

FIGS. 5 and 6 illustrate perspective left and right side views, respectively of one embodiment for the driving portion of the lid opening mechanism of the present invention, and FIGS. 7 and 8 illustrate enlarged views of the main portion of FIGS. 5 and 6, respectively.

As shown in FIGS. 5–8, a support bracket 502 is mounted along an inside wall 11*a* so as to position a driving portion 504 of a door opening/closing mechanism constructed in accordance with the principles of the present invention, adjacent the lid 86 of freezer 12. Driving portion 504 includes a first bracket fixedly secured to bracket 502, and a second bracket 508 pivotally mounted be a pivot pin 510 to bracket 506. Mounted to bracket 508 is a motor 512 for driving a pinon gear 514. As more clearly shown in FIG. 8, mounted to bracket 508 is a U-shaped slide mechanism 515 in which an elongated rack 516 is forced to slide in a vertical up or down direction in response to forward or reverse rotation, respectively, of pinon gear 514.

Mounted at an upward pointing end of rack 516 is a claw 518, and mounted at the opposed end of rack 516 is a tab portion 520.

Operation of this illustrated embodiment of the door (lid) opening/closing mechanism is accomplished by motor 512 causing rotation of gear 514, and appropriate raising and lowering of claw 518 so as to selectively engage and disengage portion 402 shown in FIG. 4 which is attached to lid 86. Upon reaching the fully opened position, tab 520 contacts a switch 522 mounted at the bottom of bracket 508, so as to signal to the control mechanism (not shown) of vending machine 10, that the upward range of motion for the opening/closing mechanism has been reached. A second switch mechanism 524 is mounted on bracket 502 and a position designed to contact a leading edge of lid 86 when it is fully closed. Accordingly, when lid 86 is fully closed, switch mechanism 524 sends a signal to the control mechanism indicating that the driving of motor 512 should be terminated. Bracket 526 is used to secure the electrical control wires, not shown, between motor 512 and the control mechanism.

It is noted that due to the fixed location of the lid opening/closing mechanism 504, and the moving position of the lid engagement and 402, the driving portion a mechanism 504 is mounted using pivot pin 510.

FIG. 9 illustrates the position of portions of the lid opening mechanism in accordance with one aspect of the present invention, at a time before initial engagement of claw 518 with pin 402.

FIGS. 10*a* through 10*d* illustrate operation of the lid opening/closing mechanism constructed and operating in accordance with one embodiment of the present invention, throughout various portions of the range of motion of the 86.

Figure 10A:
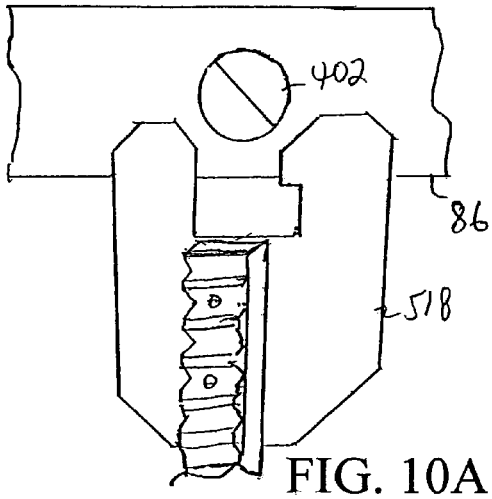
Figure 10B:
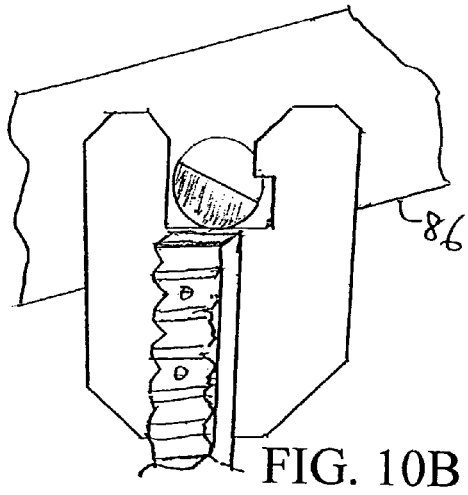
Figure 10C:
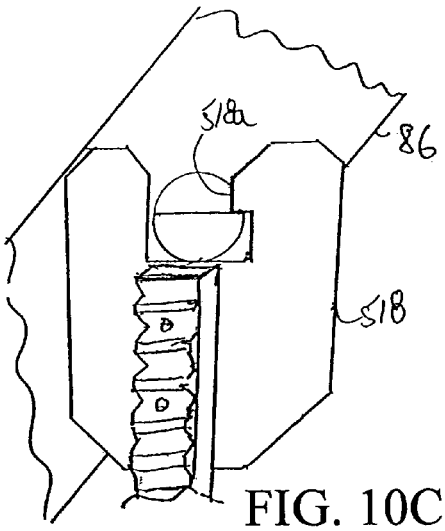
Figure 10D:
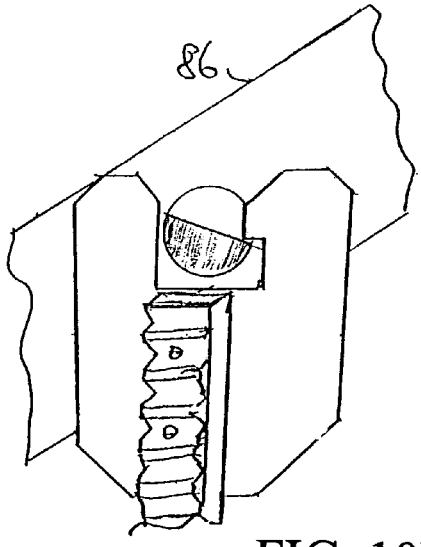

More specifically, FIG. 10*a* shows the relative position between the claw 518 and pin 402 when the claw is in either a rest position, while lid 86 is closed, or while claw 518 has started its upward movement in response to activation of motor 512. FIG. 10*b* shows the relative position between the claw 518 and pin 402 when lid 86 is being driven in the upward direction, i.e. opened. FIG. 10*c* shows the relative position between the claw 518 and pin 402 when lid 86 is fully opened. Note that pin 402 is tightly engaged within an inner opening formed by the side walls and a tab portion 518*a* of claw 518. FIG. 10*d* shows the relative position between the claw 518 and pin 402 when lid 86 is being driven in the downward direction, i.e. closed. The stop, or rest, position of the arrangement would be similar to that shown in FIG. 10*a*. Further description of the features and advantages of the novel lid opening/closing mechanism are described in the forenoted Summary Of The Invention portion of this description, and accordingly will not be repeated here.

Note that due to the pivoting action of support bracket 508, rack 516 is allowed to tilt, as will be necessary during its engagement with lid 86 as it pivots during the opening and closing operation.

In an alternative embodiment, the precise cross-sectional dimensions for pin 402 and the horizontal and vertical dimensions of the opening in claw 518 can be adjusted so as to provide a substantially vertical open position for lid 86.

FIGS. 11 and 12 illustrate front and back views, respectively of an alternative embodiment 1100 of the engaging portion of a lifting mechanism which is constructed and operates in accordance with the principles of the present invention. More specifically, claw 1100 comprises a first piece 1102 fixedly attached to the top end of rack 516, and a pivoting piece 1104 attached to rack 516 using a pivot pin 1105. A spring 1106 is position between pieces 1102 and 1104 so as to provide a force which urges an upper portion of piece 1104 to be positioned adjacent piece 1102 and define therewith an engaging hook area 1107. The general operation of claw 1100 is substantially the same as described above for claw 518. During the upward movement of rack 516, a shoulder portion 1110 of piece 1104 strikes pin 402, and thereby overcomes the urging force of spring 1106, allowing pin 402 to reside in the hook area 1107. Spring 1106 provides the force for retaining the pieces which form hook area 1107 in the closed position during the remainder of the raising and substantially all of the closing portion of the range of motion of lid 86 during the dispensing operation. Upon rack 516 lowering lid 86 to the point that it is near the fully closed position, a shoulder portion 1108 of piece 1104 engages slide 515 (shown in FIG. 8), thereby pivoting piece 1104 so as to "open" hook area 1107, thereby releasing pin 402 from its reliable and secure engagement with the lid opening/closing mechanism.

The present invention as described above provides a novel door opener/closer for use, for example, in a vending machine, although it is noted that other environments are also appropriate for the invention.

Features and advantages of the novel lid opening/closing mechanism, as noted above and as described in the forenoted Summary Of The Invention portion of this description, allow for opening/closing movement of the lid be accomplished by a mechanism which will:

Reliably and securely raise the lid to its fully open position

Reliably and securely hold the lid at its fully open position,

Reliably and securely pull the lid towards the closed position after it has been put into a fully open position, Reliably and securely position the lid to the fully closed position upon completion of a dispensing operation.

Reliably and fully disengage from the lid when not in use so as to not interfere with manual operation of the lid, which manual operation may be desired during reloading or servicing of the machine, or in the event of a power failure.

While the present invention has been disclosed with reference to certain embodiments, numerous modifications, alterations and changes to the described embodiments are possible without departing from the sphere and scope of the present invention, as defined above, and as defined in the following numbered paragraphs, if provided.

For example, the above described vending machine environment for the opening/closing arrangement of the invention is merely illustrated environment in which the invention is useful. Other environments are possible, such as in an article dispenser which is not cooled, or more generally, in an article handler. Additionally, although lid 86 is provided over a freezer 12, the article storage area may not be refrigerated to the extent of freezing, or alternatively may not be refrigerated all. These and other alternative embodiments are considered to be within the scope of the present invention.

Accordingly, it is intended that the present invention not be limited to the described embodiments, but that it has a full scope as defined by the above language and its equivalents as would be apparent to one of ordinary skill in this technology.

What is claimed is:

1. An article storage area and lid opening mechanism therefore comprising:

an article storage area, having an article dispensing opening at a top portion thereof, and a hinged lid mounted over the opening so as to have at least a predetermined range of arcuate movement thereover between a lid open and a lid closed position, said lid having a lifting portion thereon adapted for engagement with a lid opening/closing mechanism, and a lid opening/closing mechanism mounted adjacent the article storage area and positioned in a spaced-apart relationship to the lid lifting portion when the lid is in the closed position, the mechanism having:

an engaging portion adapted for engaging the lid lifting portion, and a drive portion for alternately driving the engaging portion in a direction toward the lid lifting portion during a lid opening operation, and then the driving the engaging portion in a reverse direction during a lid closing operation, wherein the engaging portion is adapted to contact the lid lifting portion while being driven by the drive portion toward the lid lifting portion during a lid opening operation, and at a time after initial contact with the lid lifting portion become positively engaged to the lid lifting portion, and the engaging portion is adapted to remain positively engaged with the lid lifting portion during the remainder of the lid opening operation, and then positively disengage from the lid lifting portion while the engaging portion is driven in the reverse direction and after the lid has moved over substantially all of said predetermined range of arcuate movement during the lid closing operation.

2. The article handler of claim 1, wherein the engaging portion is adapted to be positively engaged with the lid lifting portion for a substantial portion of the entire predetermined range of arcuate movement of the lid.

3. The article handler of claim 1, wherein the lid lifting portion comprises a pin extending from a side of the lid, and the engaging portion comprises a claw adapted to rotatably engage the pin.

4. The article handler of claim 3, wherein the pin has a round cross-section, and the claw comprises a spring-loaded pivoting arm having a hook at one end which engages the pin upon pressured contact with the pin, and disengages the pin upon the other end of the pivoting arm engaging a protrusion.

5. The article handler of claim 4, wherein the protrusion is a part of the drive portion which is positioned so as to be associated with the lid nearing a closed position, i.e., near the end of the predetermined range of travel.

6. The article handler of claim 3, wherein the pin has a D-shaped cross-section which includes an arcuate segment that establishes a maximum diameter for said pin, and a chord segment that establishes a width dimension for said cross-section which is less than said maximum diameter, said pin being positioned on the lid so as to present to the approaching claw said cross-section which has a width dimension which is less than said maximum diameter.

7. The article handler of claim 6, wherein the claw comprises a fork having opposed sidewalls spaced apart from one another by a distance which is at least equal to the maximum diameter of the pin.

8. The article handler of claim 7, wherein one of the sidewalls of the claw includes a tab portion which reduces the spacing between the sidewalls at an entrance into the fork to a distance which is less than the maximum diameter of the pin but greater than the width dimension of said cross-section which is less than said maximum diameter of the pin.

* * * * *